US012257490B2

(12) United States Patent
Edmond et al.

(10) Patent No.: US 12,257,490 B2
(45) Date of Patent: Mar. 25, 2025

(54) DEVICE FOR LOCKING A BINDING TO A SNOWBOARD COMPRISING A PIVOTING LOCKING LEVER

(71) Applicant: NIDECKER SA, Rolle (CH)

(72) Inventors: Jean-Pierre Edmond, Monnetier-Mornex (FR); David Fernandez, Grand-Lancy (CH); Thierry Kunz, Saint-Prex (CH); Daniel Schmäh, Etoy (CH)

(73) Assignee: NIDECKER SA, Rolle (CH)

( * ) Notice: Subject to any disclaimer, the term of this patent is extended or adjusted under 35 U.S.C. 154(b) by 0 days.

(21) Appl. No.: 18/250,376

(22) PCT Filed: Nov. 26, 2021

(86) PCT No.: PCT/EP2021/083254

§ 371 (c)(1),
(2) Date: Apr. 25, 2023

(87) PCT Pub. No.: WO2022/112538

PCT Pub. Date: Jun. 2, 2022

(65) Prior Publication Data

US 2023/0415022 A1 Dec. 28, 2023

(30) Foreign Application Priority Data

Nov. 27, 2020 (FR) ..... 2012263

(51) Int. Cl.
*A63C 10/18* (2012.01)

(52) U.S. Cl.
CPC ..... *A63C 10/18* (2013.01)

(58) Field of Classification Search
CPC ..... A63C 10/18
See application file for complete search history.

(56) References Cited

U.S. PATENT DOCUMENTS 5,277,635 A 1/1994 Gillis
9,072,959 B2 * 7/2015 Bernal Bascunana ..... A63C 10/10

(Continued)

FOREIGN PATENT DOCUMENTS

DE 19700291 A1 7/1998
EP 2002870 A1 12/2008

(Continued)

OTHER PUBLICATIONS

International Search Report and Written Opinion issued on Mar. 16, 2022, in corresponding International Application No. PCT/EP2021/083254, 13 pages.

*Primary Examiner* — Brian L Swenson
(74) *Attorney, Agent, or Firm* — Maier & Maier, PLLC

(57) ABSTRACT

A device for locking a binding to a snowboard, comprising a disc, having a base attached to the snowboard and housed in an opening of a base of the binding and a lever, which is hinged to the base and pivots from an unlocking position to a locking position, wherein the base is locked in any angular position relative to an axial direction of the base of the disc, the opening of the base being provided with a shoulder; According to the invention, the lever is a locking lever, overlapping the shoulder of the opening of the base in the locking position and transmitting a clamping force onto said shoulder, exerted by a clamping means, the lever fitting into the opening of the base in the unlocking position.

9 Claims, 21 Drawing Sheets

(56) References Cited

U.S. PATENT DOCUMENTS

| | | | | |
|---|---|---|---|---|
| 9,259,638 | B2 * | 2/2016 | Reguis | A63C 10/22 |
| 2001/0038182 | A1 * | 11/2001 | Carlson | A63C 10/20<br>280/14.22 |
| 2004/0056451 | A1 * | 3/2004 | Baikhardt | A63C 10/18<br>280/618 |
| 2004/0207166 | A1 * | 10/2004 | Elkington | A63C 10/18<br>280/14.24 |
| 2009/0194956 | A1 * | 8/2009 | Holzer | A63C 10/18<br>280/14.24 |

FOREIGN PATENT DOCUMENTS

| | | | |
|---|---|---|---|
| FR | 2627097 | A1 | 8/1989 |
| FR | 2829034 | A1 | 3/2003 |

* cited by examiner

DEVICE FOR LOCKING A BINDING TO A SNOWBOARD COMPRISING A PIVOTING LOCKING LEVER

FIELD

The invention relates to a device for locking a binding to a snowboard, comprising more particularly a disc, having a base attached to the snowboard and housed in an opening of a base of the binding, and a lever which is hinged to the base of the disc and pivots from an unlocking position to a locking position, wherein the base is locked in any angular position relative to an axial direction of the base of the disc, the opening of the base being provided with a shoulder.

BACKGROUND

A device of this type is disclosed by document DE 197 00 291. The lever is a clamping lever, acting on a locking disc, which is movable in translation in the axial direction along guides, to overlap the shoulder of the base through an intermediate disc, connected in rotation to the base, and transmit the clamping force exerted by the lever onto said shoulder. In addition, the locking disc guided in axial translation is, in any position between the locking position and the unlocking position, capable of overlapping the shoulder of the intermediate disc, with no possibility of fitting into the opening of said disc, in the unlocking position.

Document EP 2 200 870 discloses a locking device of a similar type, except that no lever is hinged to the base of the disc. The angular locking of the binding and the clamping of the locking position are obtained by sliding a coupling element relative to the base, to engage with a shoulder of a disc attached to the snowboard.

U.S. Pat. No. 5,277,635 also discloses a locking device of a similar type, except that the lever is hinged to the base. Unlike the claimed invention, the lever is a clamping lever, exerting a force onto a flexible tie clamped around a shoulder of the disc attached to the snowboard.

Document FR 2 829 034 discloses a locking device of a different type, according to which locking means comprise two bolts, guided in translation relative to the base of the disc, from the unlocking position to the locking position. The overlap in the locking position comprises a surface, inclined relative to the axial direction, formed at one end of each bolt and intended to cooperate by complementarity with an inclined surface formed on the periphery of the opening of the base. The bolts are controlled in opposite directions by a pinion or a cam of the clamping means, to transmit the clamping force onto the base using the complementary inclined surfaces.

To improve the locking of the base in the angular position about the axial direction, a cylindrical set of teeth is formed on the base of the disc, the teeth extending in the axial direction. In the unlocking position of the bolts, the base is inserted in the axial direction in a complementary set of teeth, formed on the periphery of the opening of the base.

Document FR 2 627 097 discloses a device of a type different from the previous one in that, in the locking position, the two bolts lock the base in rotation about an axial direction of the disc, using a set of teeth formed at the end of each bolt, complementary to a cylindrical set of teeth of the opening. In the unlocking position, the bolts unlock the binding, to rotate it about the axial direction, in a new angular position. The bolts are controlled in translation in opposite directions, by a lever of the clamping means, which is hinged to one of the bolts.

To remove the binding according to this last document, the disc must be unscrewed from the snowboard. On the contrary, according to the first document, removing the overlap in the unlocking position allows the binding to be removed without unscrewing the disc. However, complementary inclined surfaces must be provided between the opening of the base and the locking means.

SUMMARY

The purpose of the invention is to provide an alternative to a known locking device of document DE 197 00 291.

To this end, the invention relates to a device for locking a binding to a snowboard, comprising a disc, having a base attached to the snowboard and housed in an opening of a base of the binding and a lever, which is hinged to the base and pivots from an unlocking position to a locking position, wherein the base is locked in any angular position relative to an axial direction of the base of the disc, the opening of the base being provided with a shoulder, characterized in that the lever is a locking lever, overlapping the shoulder of the opening of the base in the locking position and transmitting a clamping force onto said shoulder, exerted by a clamping means, the lever fitting into the opening of the base in the unlocking position.

In the locking position, the lever locks any axial movement of the base and transmits the clamping force like a jaw by biting on the opening, whereas in the unlocking position, it can be used to unlock the binding to remove it from the snowboard, by passing the lever through the opening of the base. In this position, the lever can also be used to change the angular position of the base relative to the snowboard.

An efficient and reliable locking device is therefore obtained, that can be used to quickly assemble and disassemble the binding on the snowboard and that does not require complementary inclined surfaces between the opening of the base and the locking means.

Advantageously, the pivoting lever carries a set of teeth having teeth which extend along a radius of curvature of the lever. In the locking position, the lever can thus reproduce the set of teeth of an ordinary removable binding disc, for which the teeth protrude in a plane perpendicular to the axial direction of the disc, such that the device is adapted to any standard binding, for which the complementary set of teeth, formed on the periphery of the opening, also extends perpendicular to the axial direction of the opening. Note that the teeth of the lever can be inclined relative to the axial direction of the disc, forming a conical ring centered on the axial direction. The same applies for the complementary set of teeth formed in the opening of the base.

The locking means may comprise a second lever, the two levers pivoting from the unlocking position to the locking position, about two pivoting pins carried by the base of the disc and parallel to each other. The locking means may also comprise a second lever and a third lever, the three levers pivoting from the unlocking position to the locking position, about three pivoting pins carried by the base of the disc, perpendicular to three intersecting planes, preferably making an angle of 120° between each other.

The clamping means may comprise a lever, which is hinged to the base of the disc, about a pivoting pin, inserted in grooves formed in the base, to slide relative to the base and for exerting, in the locking position, the clamping force using the pivoting pin engaged with a heel of the lever. The clamping means may also comprise two bolts, controlled in translation relative to the base by a cam, movable in rotation about the axial direction for exerting, in the locking position, the clamping force using a heel of each of the two levers, engaged with the two bolts. The clamping means may further comprise a clamping ring, which is movable in rotation about the axial direction, for exerting, in the locking position, the clamping force using a bearing surface engaged with a complementary bearing surface of both levers, the two bearing surfaces forming a helical screw thread.

The clamping means may further comprise a clamping ring, which is movable in rotation about the axial direction, for exerting, in the locking position, the clamping force using a radial arm or a tangential notch engaged with a lug of the lever.

Advantageously, the heel of the lever, or the radial arm or the tangential notch of the clamping ring is inclined relative to the axial direction.

BRIEF DESCRIPTION OF THE FIGURES

Other advantages of the invention will appear on reading the description of various embodiments illustrated by the drawings.

DETAILED DESCRIPTION

The invention is described using the various embodiments mentioned above. Elements common to these embodiments are designated by the same reference.

Figure 1:
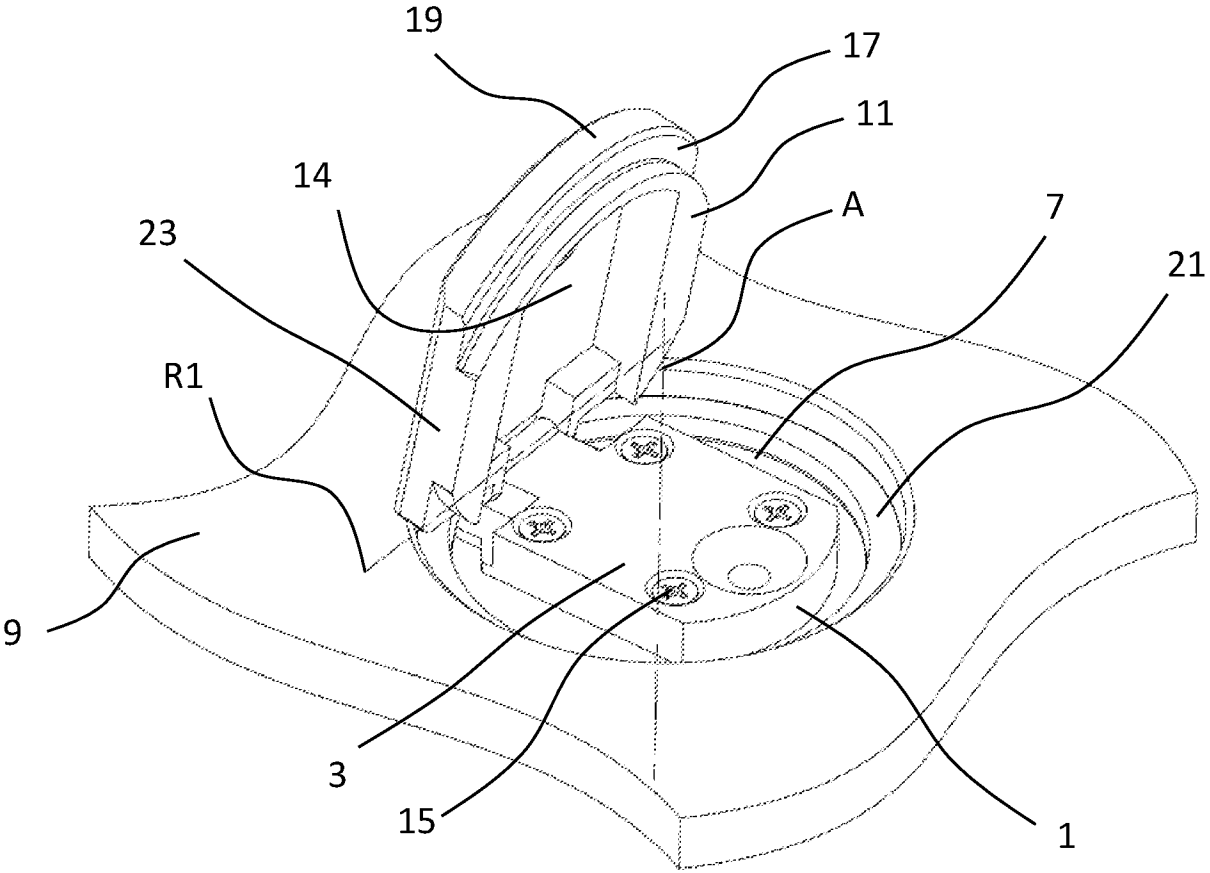
FIG. 1 is a view of a first embodiment of the invention, with a pivoting lever in an unlocking position.
Figure 2:
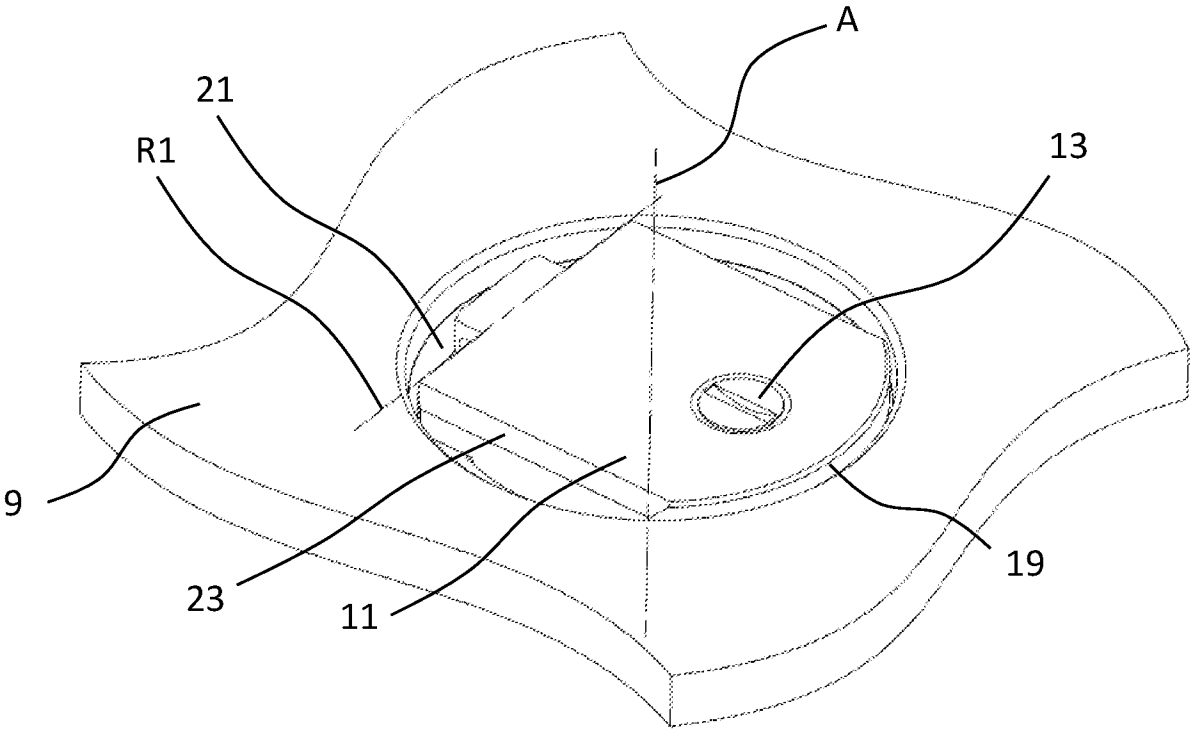
FIG. 2 is a view of the first embodiment of the invention, with a pivoting lever in a locking position.

According to a first embodiment of the invention, shown on FIGS. 1 to 2, a device for locking a binding to a snowboard comprises a disc 1, having a base 3 attached to the snowboard 5 and housed in an opening 7 of a base 9 of the binding.

A lever 11 is hinged to the base 3 of the disc 1, to pivot from an unlocking position, FIG. 1, wherein the lever 11 fits into the opening 7 of the base 9, to a locking position, FIG. 2, wherein the lever 11 overlaps the opening 7 and is rotated by a clamping screw 13, in order to transmit a clamping force onto the base 9, in any angular position of the base 9, relative to the axial direction A of the disc 1.

The base 3 of the disc 1 is attached to the snowboard 5 by screws 15. The lever 11 pivots about a pivoting pin R1 carried by the base 3 of the disc 1, in a plane perpendicular to the axial direction A. The overlap in the locking position is provided by a shoulder 17, formed on a circular periphery 19 of the lever 11 and cooperating by complementarity with a shoulder 21, formed on the circular periphery of the opening 7 of the base 9. The circular periphery 19 of the lever 11 is cut off at the sides 23 to fit into the opening 7 in the unlocking position. The lever 11 comprises a housing 14 to receive the base 3 of the disc 1 in the locking position.

In this latter position, the lever 11 locks the base 9 in the axial direction A of the disc 1 and transmits the clamping force like a jaw, by biting on the opening 7, whereas in the unlocking position, it is used to unlock the binding to remove it from the snowboard 5, by passing the lever 11 through the opening 7 of the base 9.

In this embodiment, the clamping force can be transmitted using an elastomer seal 25 arranged on one of the two shoulders 17, 21 which overlap each other in the locking position. Instead of the elastomer seal 25, the shoulders 17, 21 can be provided with a rough surface.

Figure 3:
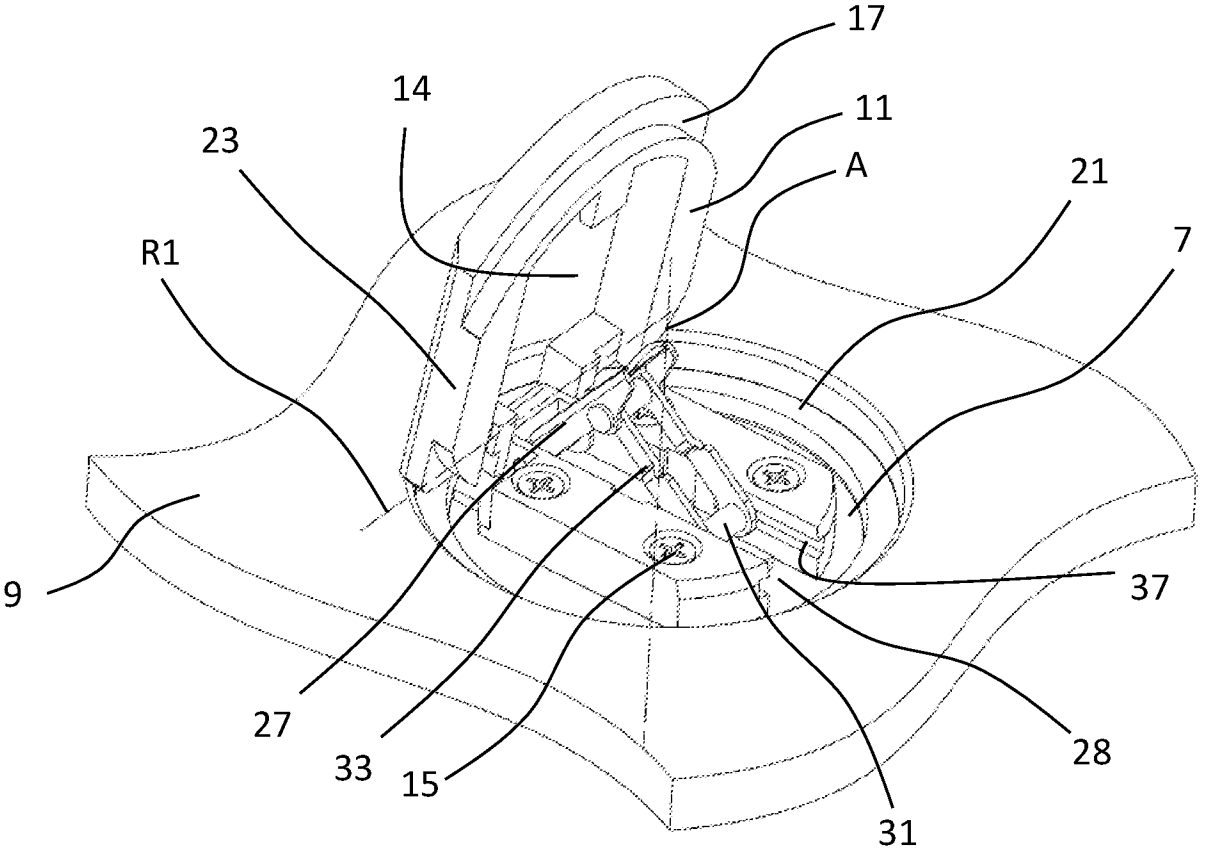
FIG. 3 is a view of a variant of the first embodiment of the invention, with the pivoting lever in the unlocking position.
Figure 4:
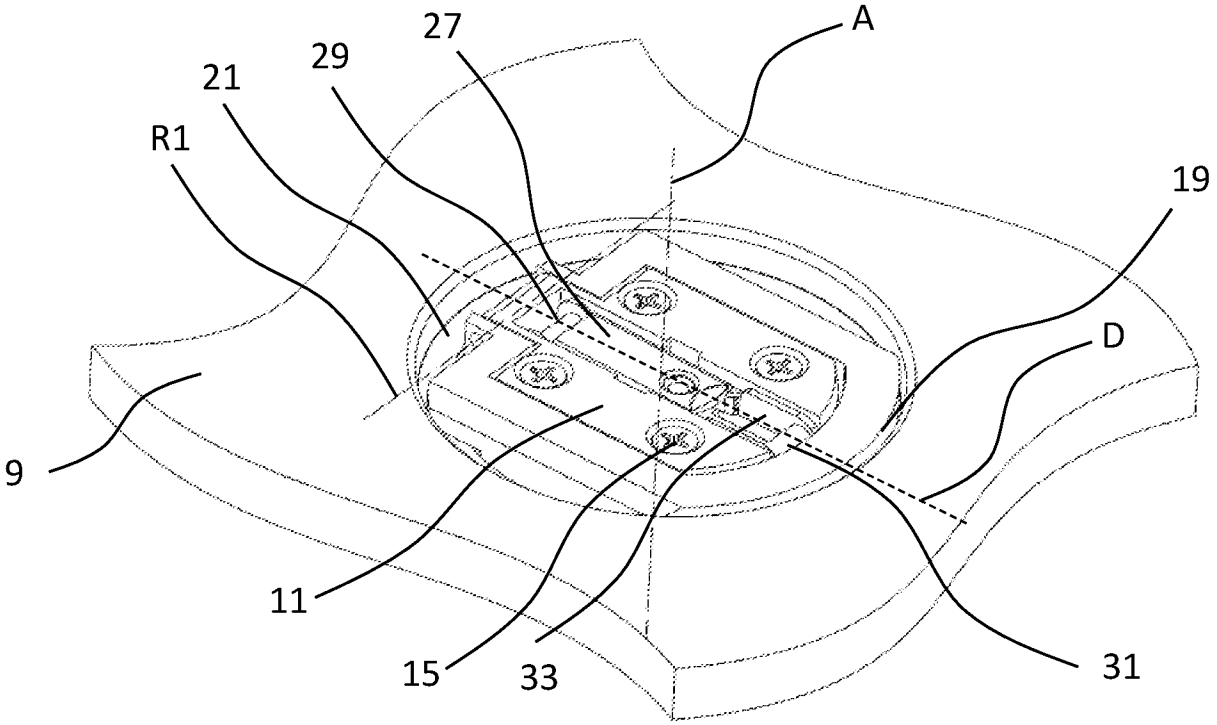
FIG. 4 is a view of the variant of the first embodiment of the invention, with the pivoting lever in the locking position.
Figure 5:
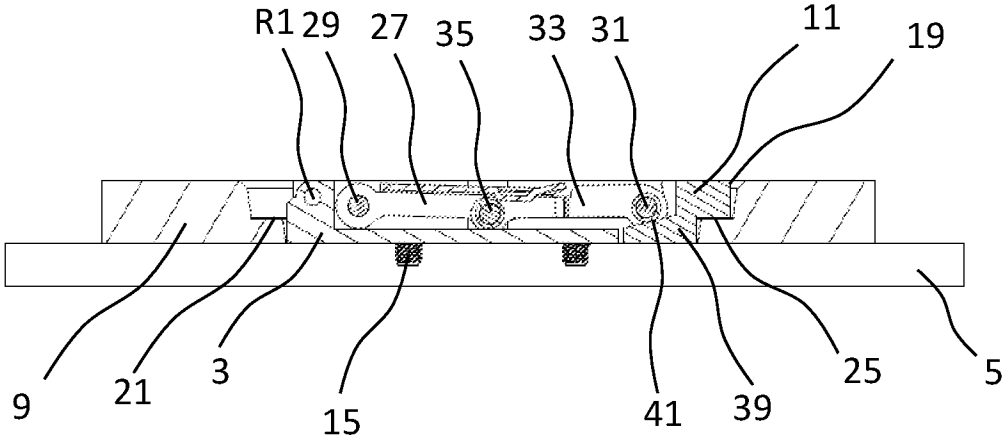
FIG. 5 is a cross-sectional view of the variant of the first embodiment of the invention, with the pivoting lever in the locking position.

FIGS. 3 to 5 show a variant of the first embodiment of the invention, which has a different clamping means. The latter comprises an operating lever 27, which is hinged to the base 3 of the disc 1 by a pivoting pin 29. The operating lever 27 forms a toggle with a follower lever 33 to which it is hinged by a hinge pin 35, the follower lever 33 being itself hinged to the base 3 of the disc 1, about a pivoting pin 31, inserted in grooves 37 formed in the base 3, to slide in a direction D perpendicular to the pivoting pin R1 of the lever 11 of the locking means. In the unlocking position, FIG. 4, the toggle is open, the operating lever 27 and the follower lever 33 being raised relative to the base 3 of the disc 1. The housing 14 of the lever 11 designed to receive the base 3 of the disc 1 in the locking position is in this case open to allow the lever to pivot in this position, without exerting force onto the operating lever 27 and the follower lever 33, in their raised position.

Once the lever 11 is in the locking position, FIG. 4 and FIG. 5, the operating lever 27 is lowered in a housing 28 of the base 3 of the disc 1, by sliding the pivoting pin 31 in the grooves 37. As it slides, the pivoting pin 31 engages with a heel 39 of the lever 11 to rotate it about the pin R1, preferably in proportion to a slope 41 formed on the heel 39. The slope 41 allows the lever 11 to transmit the clamping force more progressively, as the operating lever 27 is lowered in the closed position of the toggle. When sliding stops, the clamping force goes through a maximum when the hinge pin 35 crosses the plane going through the pivoting pin 31, inserted in the grooves 37, and the pivoting pin 29, to lock the toggle in the open position.

Figure 6:
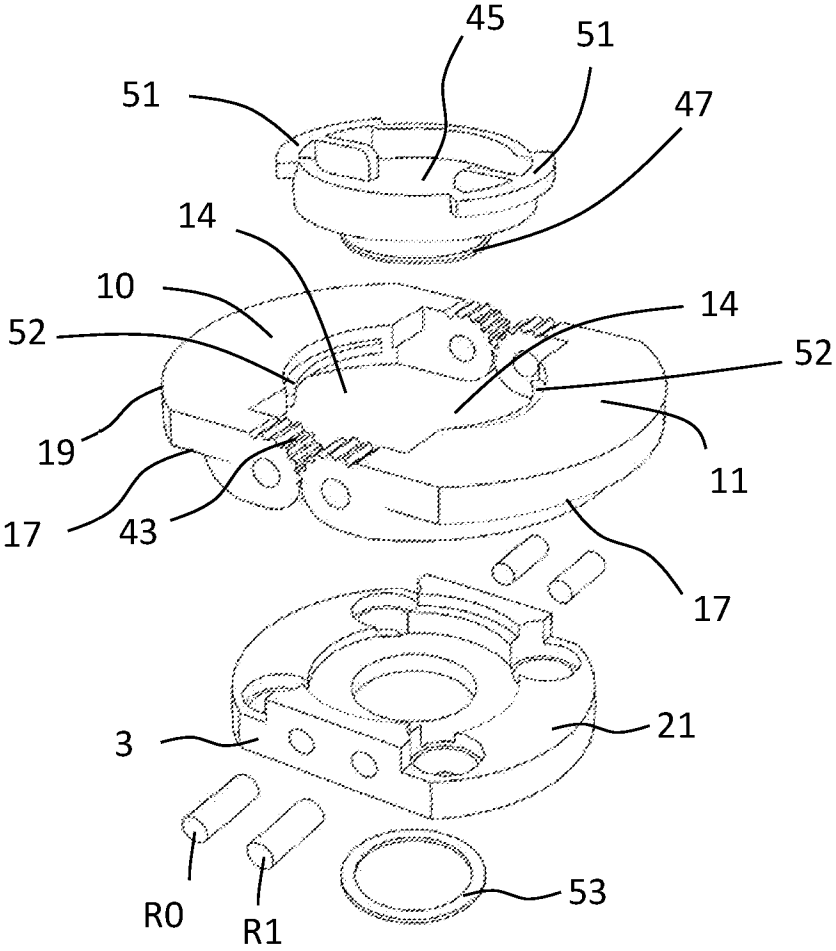
FIG. 6 is an exploded view of a second embodiment of the invention, with two pivoting levers in a locking position.
Figure 7:
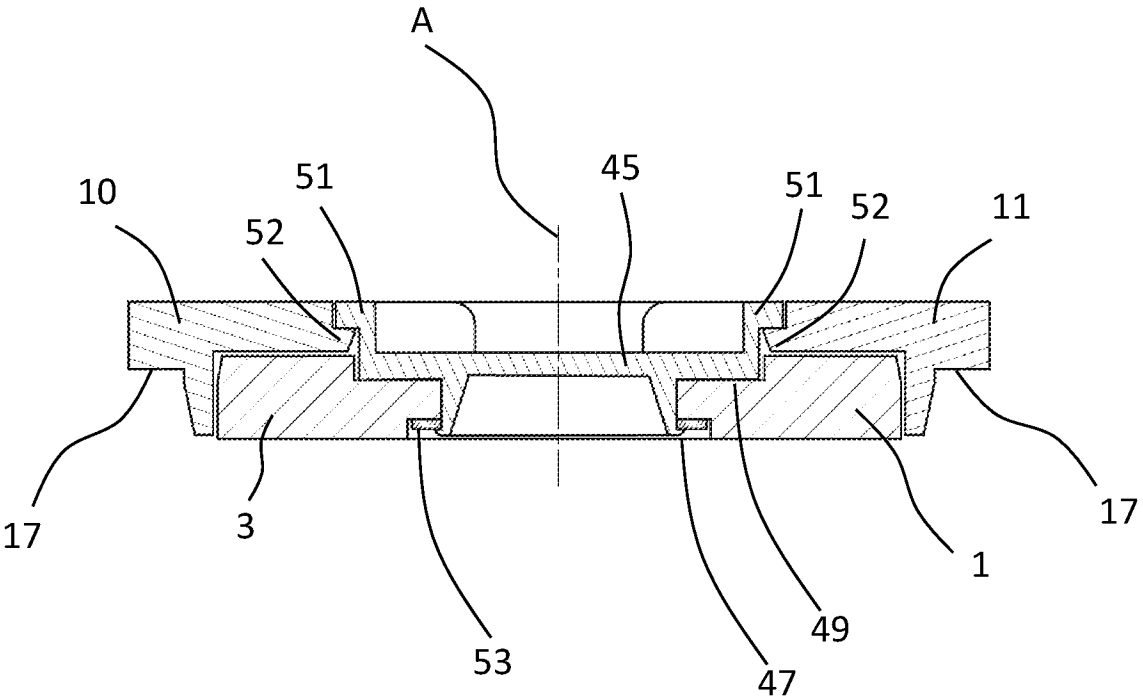
FIG. 7 is a cross-sectional view of the second embodiment of the invention, with the two pivoting levers in the locking position.
Figure 8:
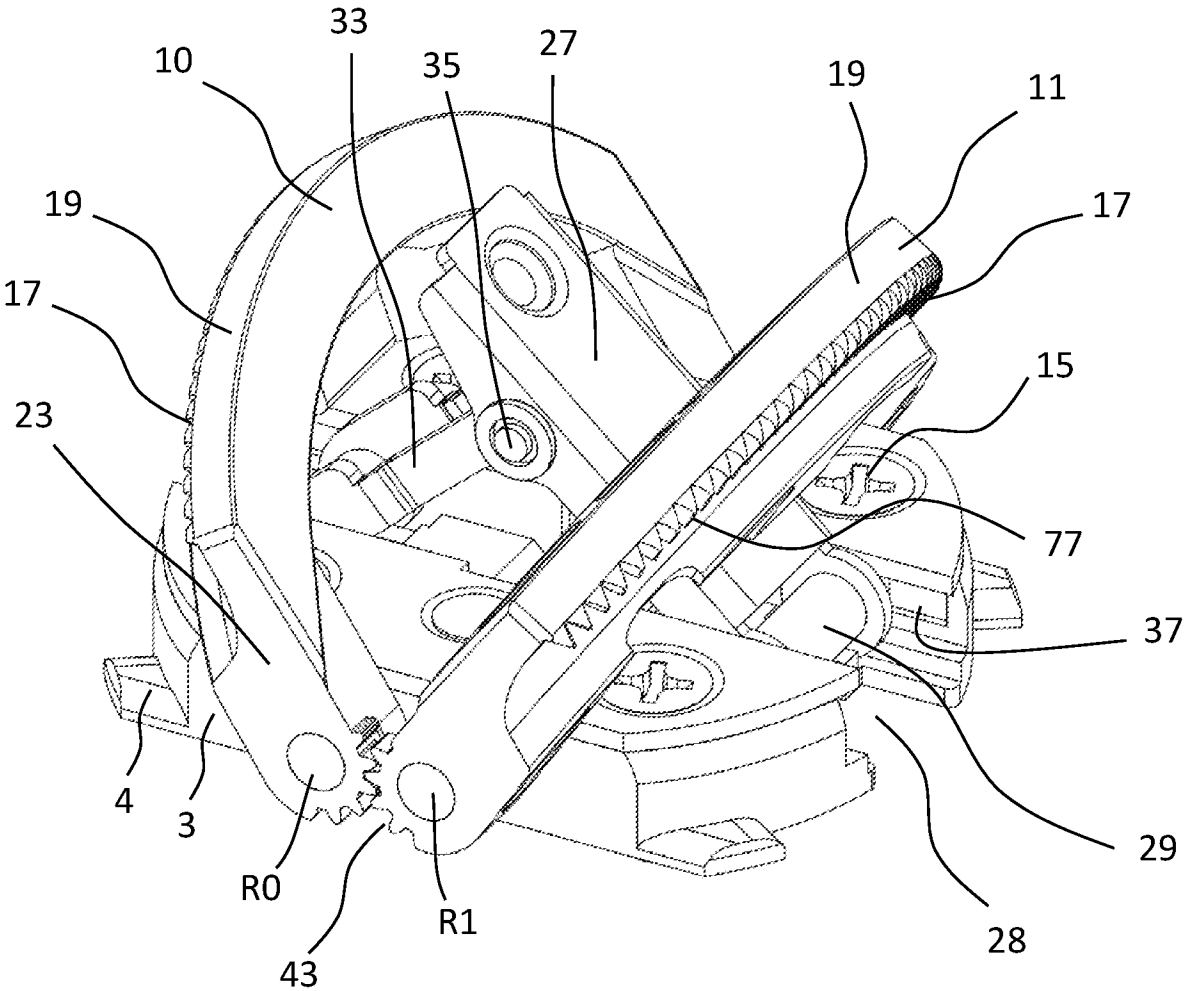
FIG. 8 is a perspective view of a first variant of the second embodiment of the invention, the two pivoting levers being in the unlocking position.
Figure 9:
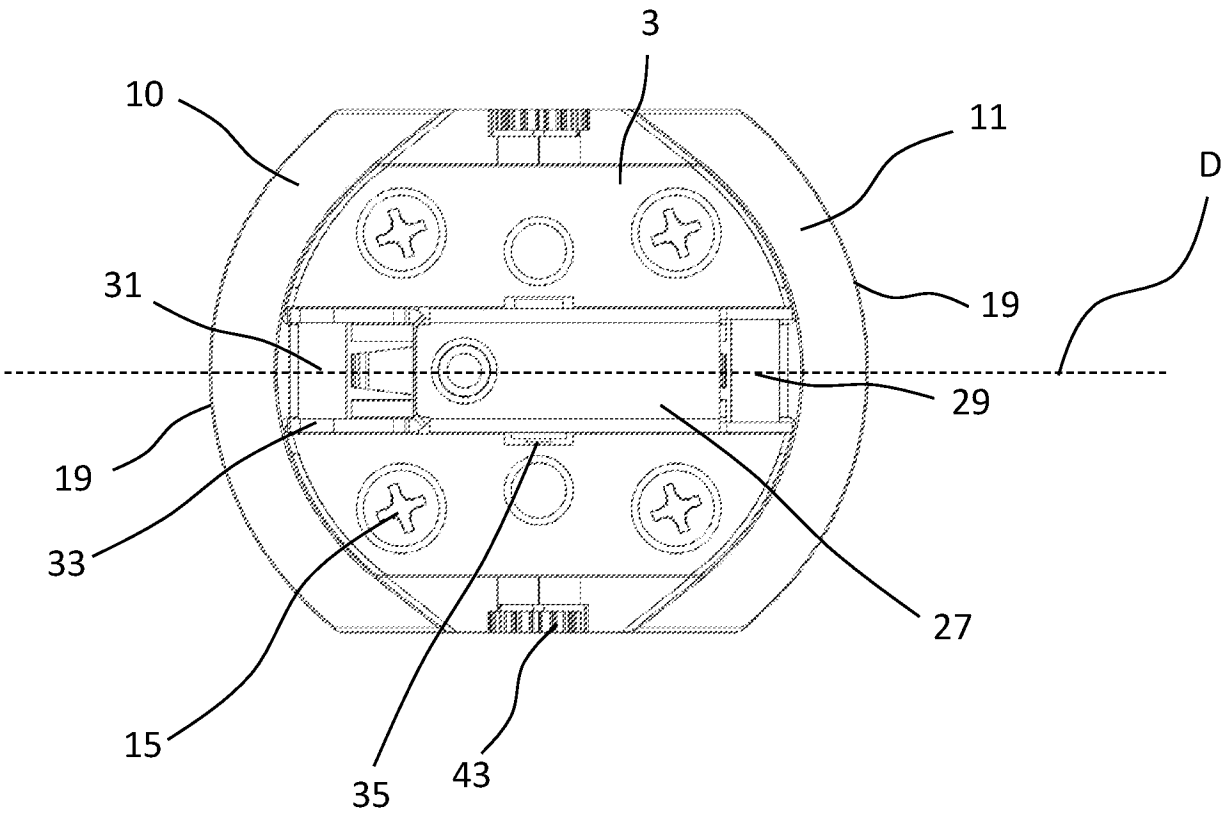
FIG. 9 is a top view of the first variant of the second embodiment of the invention, the two pivoting levers being in the locking position.
Figure 10:
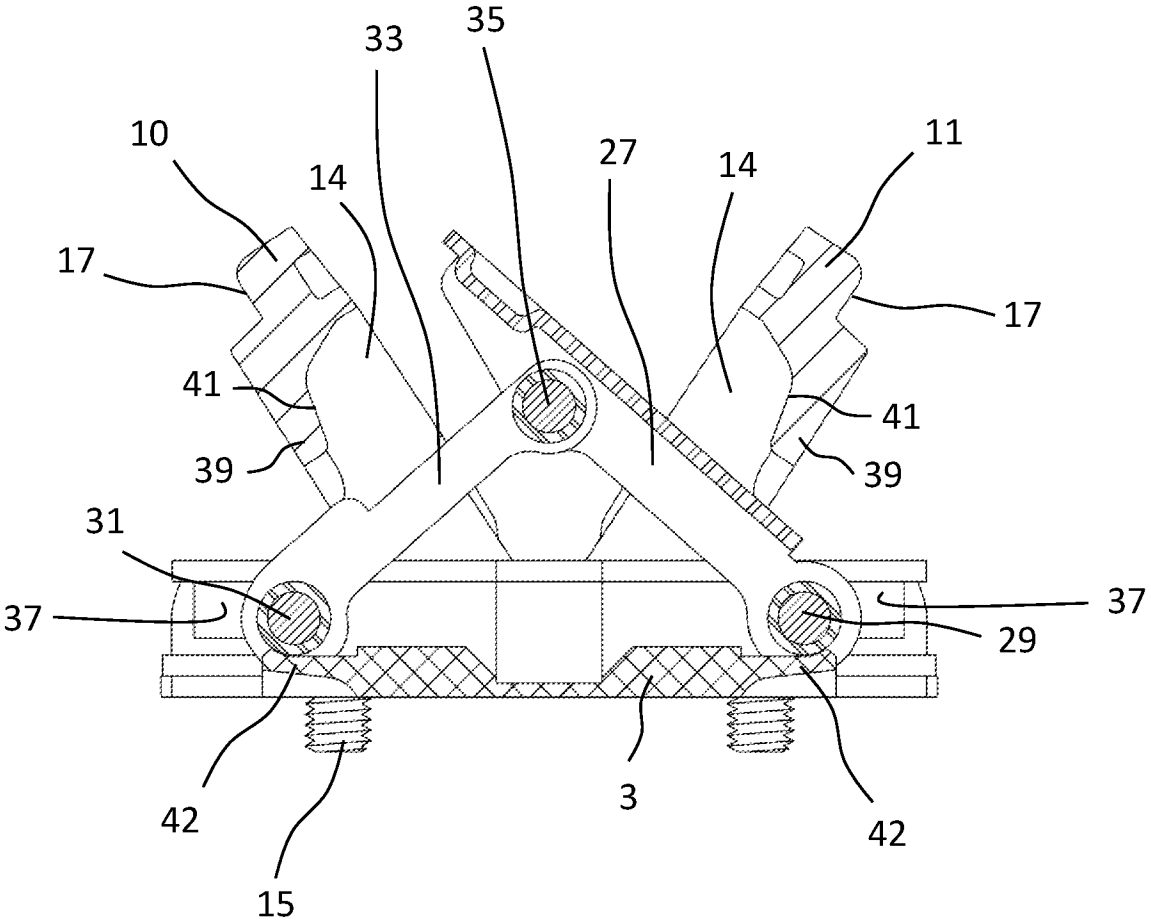
FIG. 10 is a cross-sectional view of the first variant of the second embodiment, the two pivoting levers being in the unlocking position.
Figure 11:
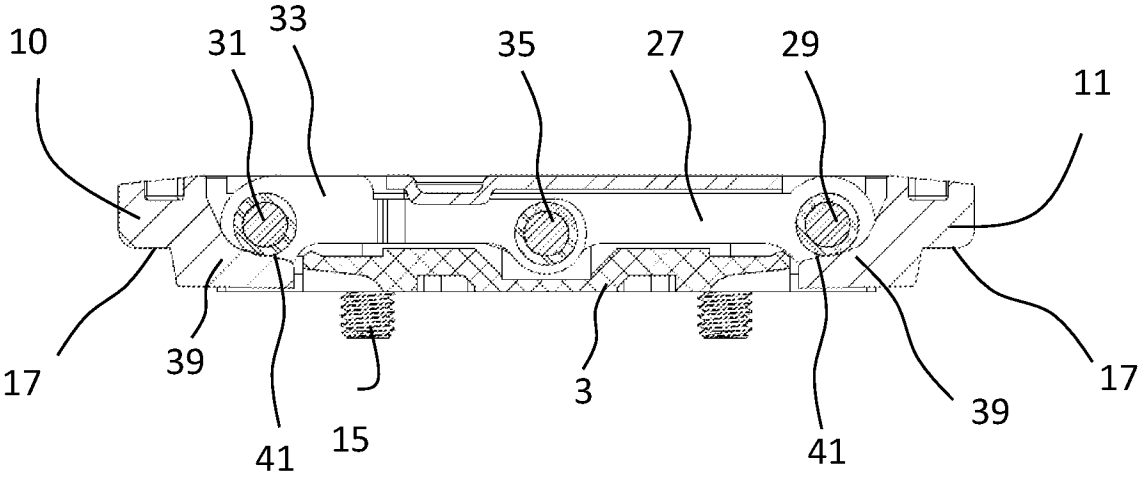
FIG. 11 is a cross-sectional view of the first variant of the second embodiment, the two pivoting levers being in the locking position.
Figure 12:
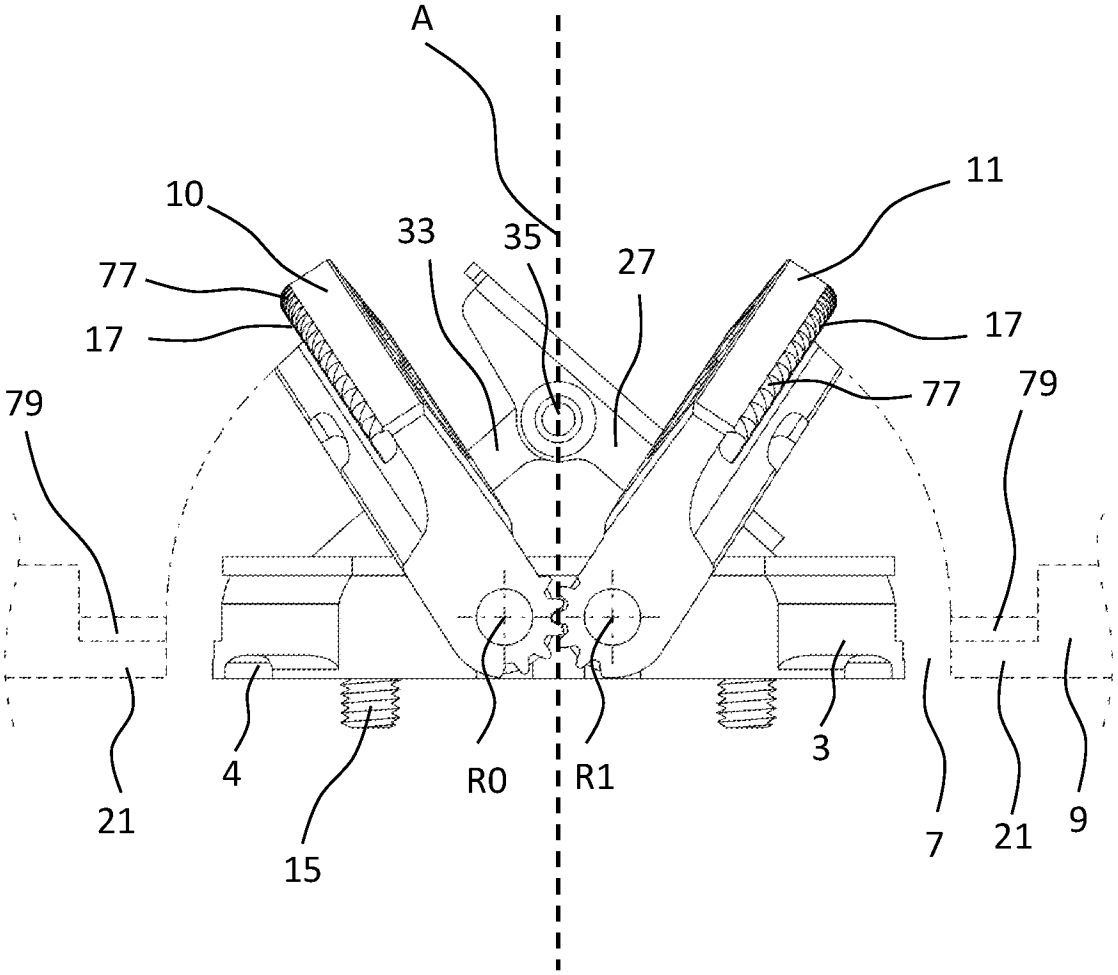
FIG. 12 is a side view of the first variant of the second embodiment of the invention, the two pivoting levers being in the unlocking position.

FIGS. 6 and 7 show a second embodiment of the invention, according to which the locking means comprise a second lever 10 similar to the first lever 11 described previously. The two levers 10, 11 pivot in opposite directions, from the unlocking position to the locking position, about two pivoting pins R0, R1 carried by the base 3 of the disc 1 and parallel to each other, in a plane perpendicular to the axial direction A. To ensure that the two levers 10, 11 pivot together, they are provided with gears 43 which mesh together. The housing 14 of each lever 10, 11, designed to receive the base 3 of the disc 1 in the locking position, is in this case open to house the clamping means.

The latter comprises a clamping ring 45, which is movable in rotation about the axial direction A of the base 3 of the disc 1. The clamping ring 45 is gripped on the base 3 of the disc 1 using a rib 47 opposite a shoulder 49. The first and second levers 10, 11 are engaged by a helical screw thread, comprising a bearing surface 51 formed in the clamping ring 45 and a complementary bearing surface 52, formed in both levers 10, 11, in a wall of their housing 14, opposite the circular periphery 19 of each lever.

In the unlocking position, the complementary bearing surfaces 51, 52 are disengaged from each other. Once the levers 10, 11 are in the locking position, FIG. 7, the clamping ring 45 is rotated about the axial direction A, to engage the bearing surfaces 51, 52 along the helical screw thread. During this rotation, the clamping ring 45 rotates the levers 10, 11 about their pivoting pin R0, R1 so that they transmit the clamping force onto the opening 7 of the base 9 by overlapping of the shoulders 17, 21. Note that a washer 53 is arranged between the rib 47 and the base 3 of the disc 1 so that the clamping ring 45 rotates more easily.

This second embodiment with two levers provides an overlapping area that is larger than that of the first embodiment and a symmetrical distribution of the clamping force, on the periphery of the opening of the base.

FIGS. 8 to 12 show a first variant of the second embodiment of the invention, which has a different clamping means. It consists once again of a toggle similar to that described previously, but adapted to the two levers 10, 11. Thus, the operating lever 27 is also hinged to the base 3 of the disc 1 by a pivoting pin 29 inserted in grooves 37 formed in the base 3 to slide, in the opposite direction to that of the follower lever 33, in the direction D perpendicular to the pivoting pins R0, R1 of the levers 10, 11. In the unlocking position, FIGS. 8 and 10, the toggle is open, the operating lever 27 and the follower lever 33 being raised relative to the base 3 of the disc 1. The housing 14 of each lever 10, 11 designed to receive the base 3 of the disc 1 in the locking position is in this case open to allow the levers to pivot into this position, without exerting force onto the operating lever 27 and the follower lever 33, in their raised position. Note the presence of wedges 4 for centering the base 3 of the disc 1 in the opening 7 of the base 9. Note also the presence of elastically deformable tabs 42 to hold the operating lever 27 and the follower lever 33 in their raised position.

Once the levers 10, 11 are in the locking position, the operating lever 27 and the follower lever 33 are lowered in the housing 28 of the base 3 of the disc 1 by sliding their pivoting pin 30, 31 in opposite directions in the grooves 37. As these two levers 27, 33 slide, their pivoting pin 30, 31 engages with a heel 39 of each locking lever 10, 11 to rotate them about their pivoting pin R0, R1, preferably in proportion to a slope 41 formed on the heel 39. The slope 41 allows the levers 10, 11 to transmit the clamping force more progressively, as the operating lever 27 is lowered in the closed position of the toggle. When sliding stops, the clamping force goes through a maximum when the hinge pin 35, between the operating lever 27 and the follower 33, crosses the plane going through their pivoting pins 30, 31, inserted in the grooves 37, to lock the toggle in the open position.

Figure 13:
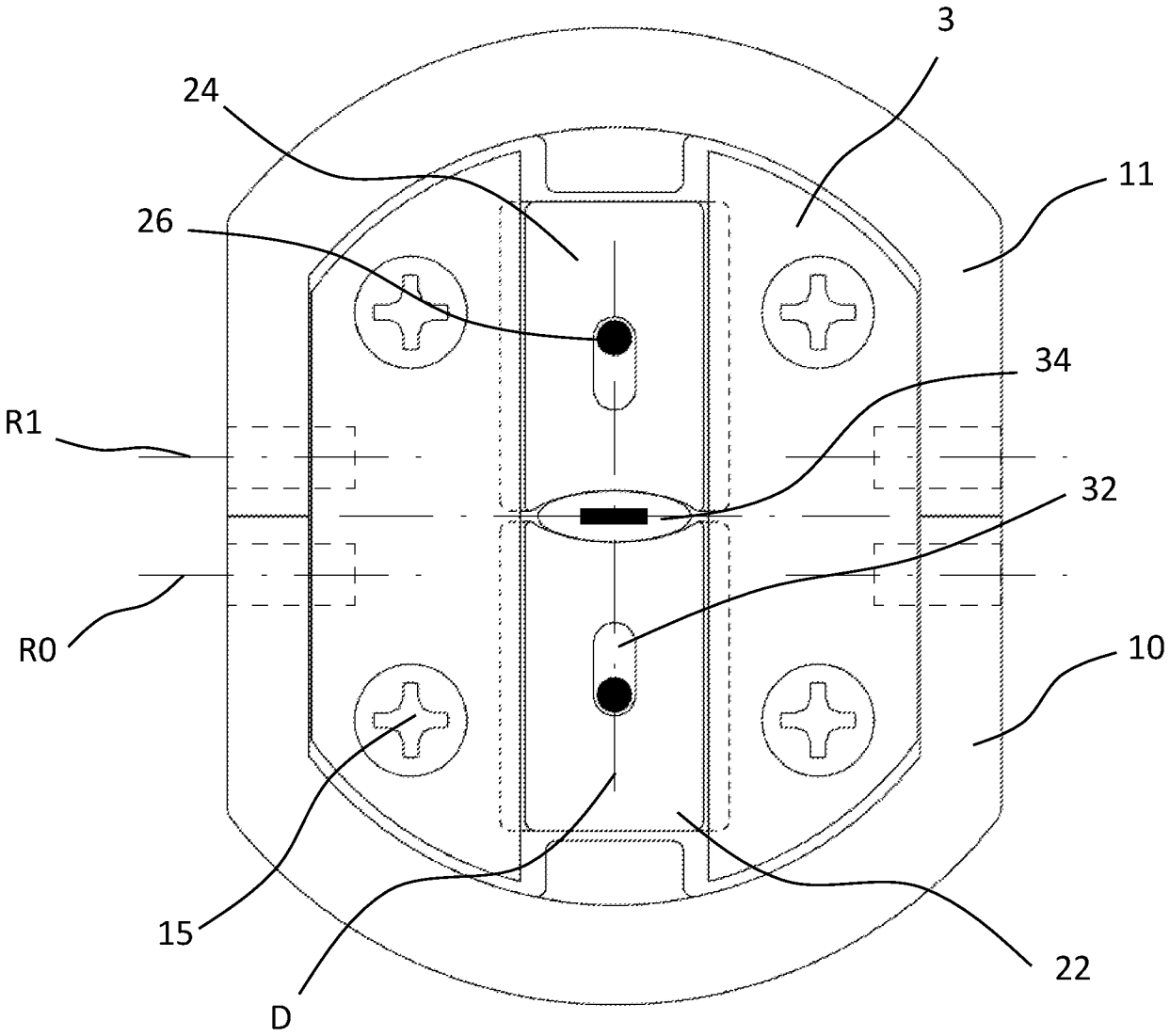
FIG. 13 is a top view of a second variant of the second embodiment of the invention, the two pivoting levers being in the locking position, before clamping.
Figure 14:
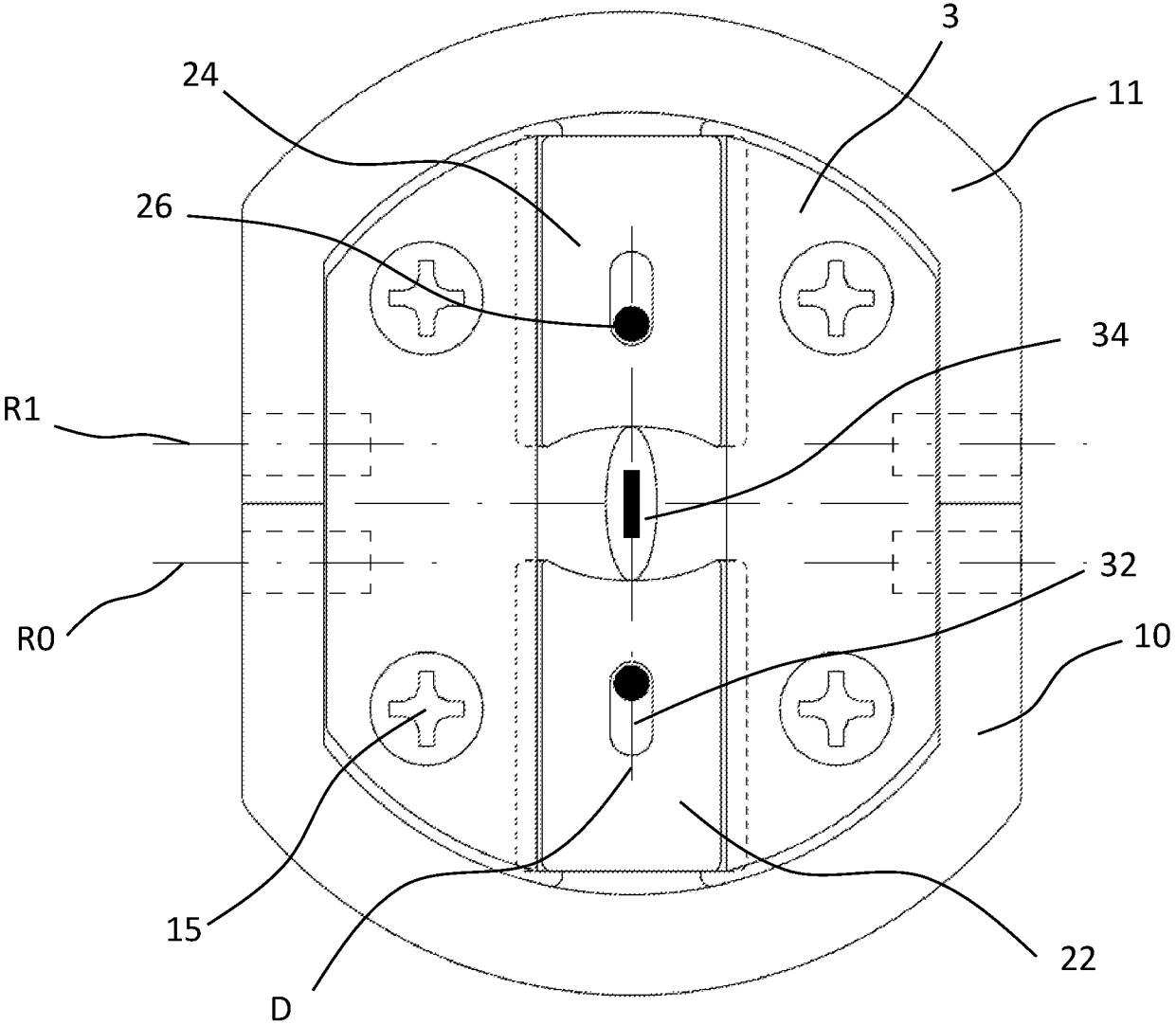
FIG. 14 is a top view of the second variant of the second embodiment of the invention, the two pivoting levers being in the locking position, after clamping.
Figure 15:
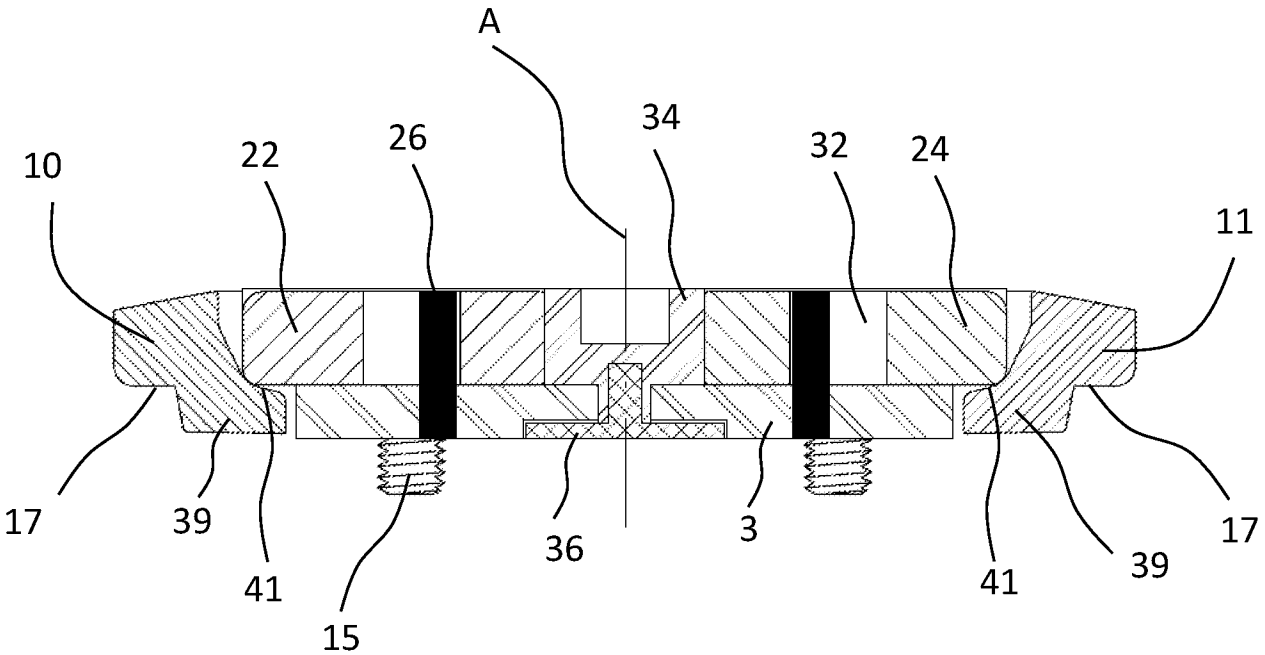
FIG. 15 is a cross-sectional view of the second variant of the second embodiment of the invention, the two pivoting levers being in the locking position, after clamping.

FIGS. 13 to 15 show a second variant of the second embodiment of the invention, which has a different clamping means. It consists in this case of two bolts 22, 24 sliding relative to the base 3 of the disc 1, in the direction D and guided in translation by rods 26 attached to the base 3 and housed in two holes 32 of the bolts. The latter are controlled, against an elastic return means (not shown), by a cam 34 held by a screw 36 to the base 3 of the disc 1 and movable in rotation about the axial direction A. In the unlocking position of the levers 10, 11, the two bolts are in an open position, separated from each other by a distance equal to the width of the cam 34, so that the levers can pivot into the locking position. Once in this position, the cam is rotated about the axial direction A to slide the two bolts 22, 24 in two opposite directions, in a closed position, separated from each other by a distance equal to the length of the cam 34, greater than the width.

As the two bolts 22, 24 slide, their opposite ends in the direction D engage with the heel 39 of each locking lever 10, 11, to rotate them about their pivoting pin R0, R1, preferably in proportion to a slope 41 formed on the heel 39. Once again, the slope 41 allows the levers 10, 11 to transmit the clamping force more progressively, as the two bolts are controlled by the cam 34 in the closed position.

Figure 16:
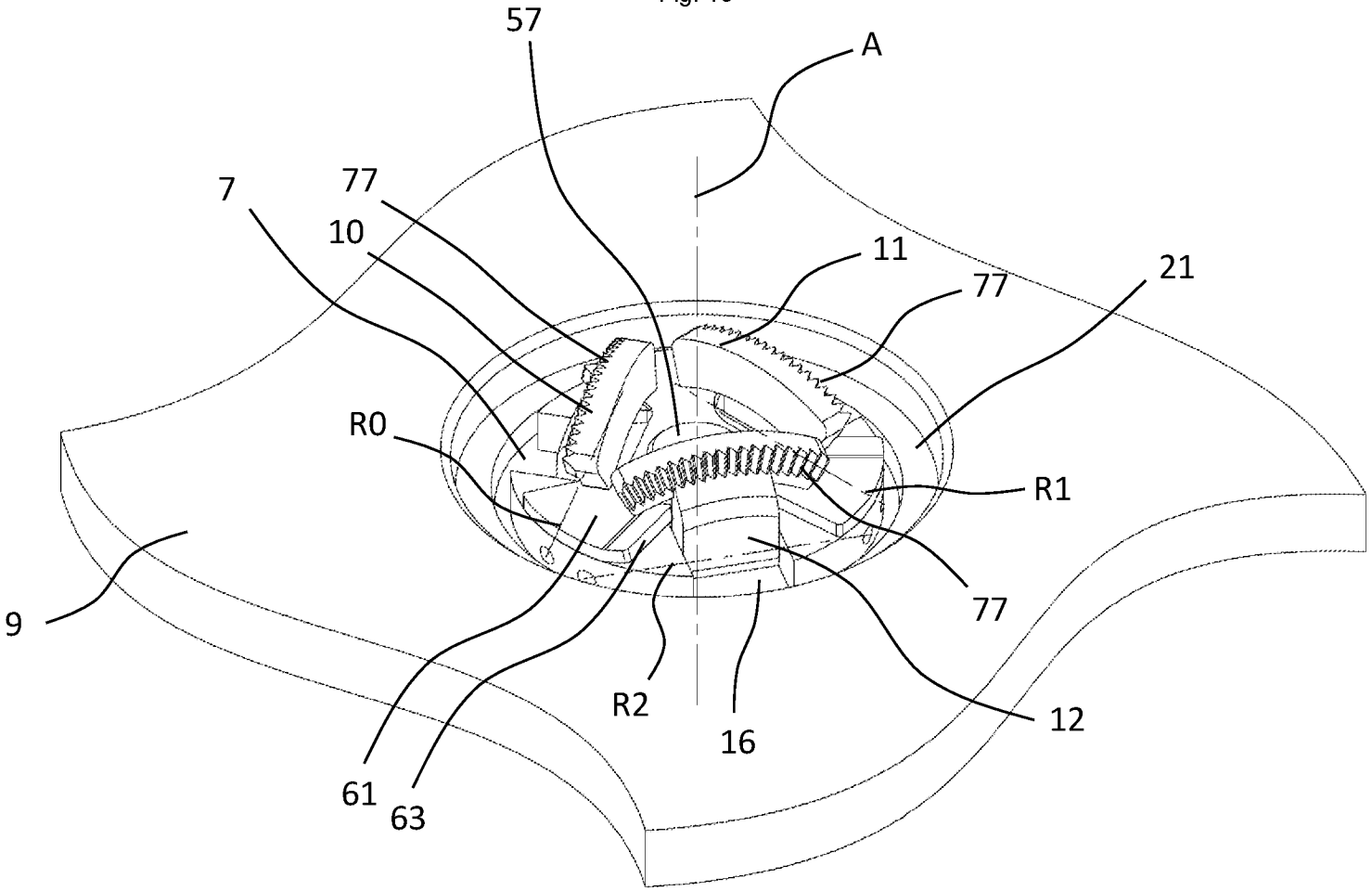
FIG. 16 is a top view of a third embodiment of the invention, three pivoting levers being in an unlocking position.
Figure 17:
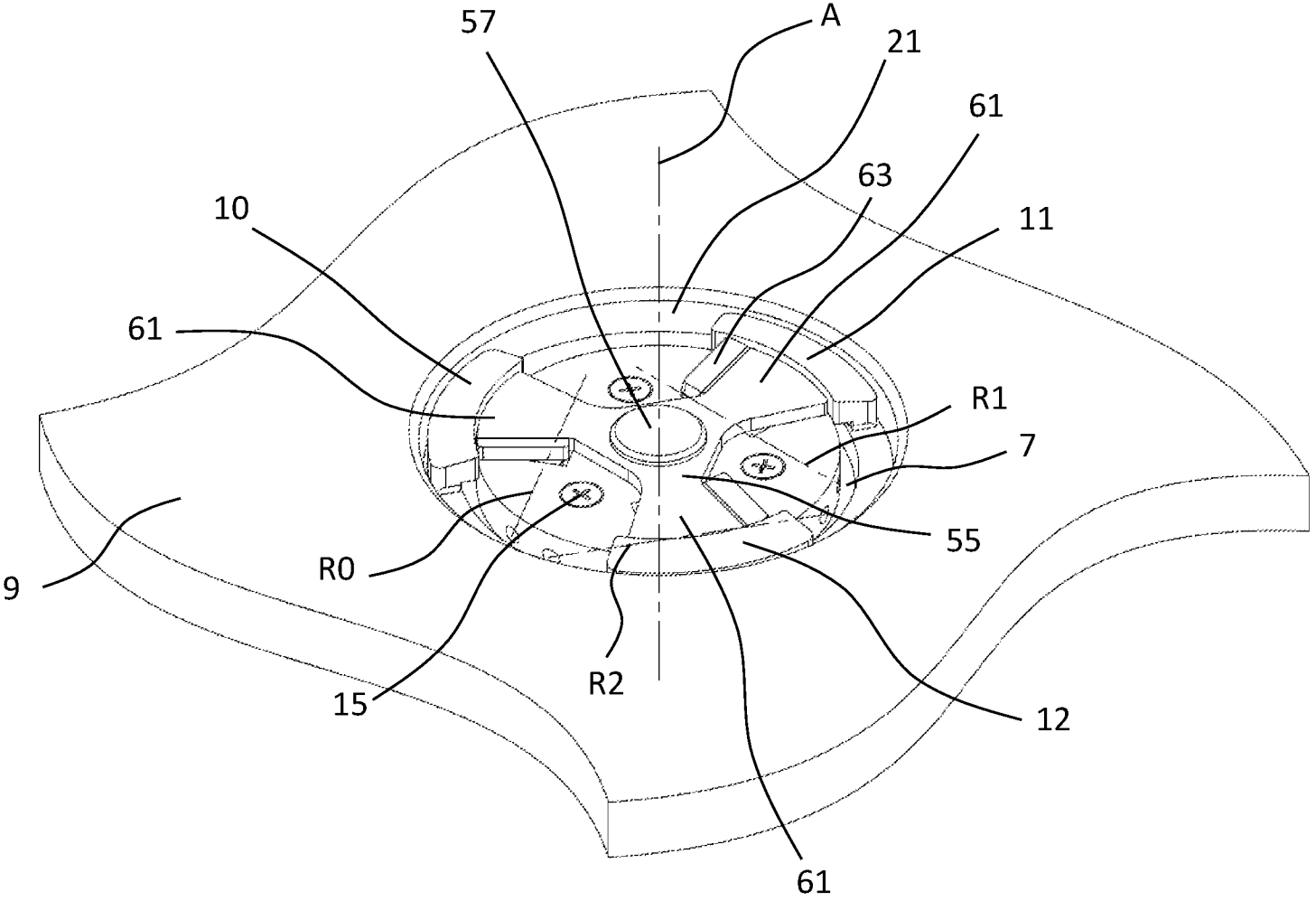
FIG. 17 is a perspective view of the third embodiment of the invention, the three pivoting levers being in a locking position.
Figure 18:
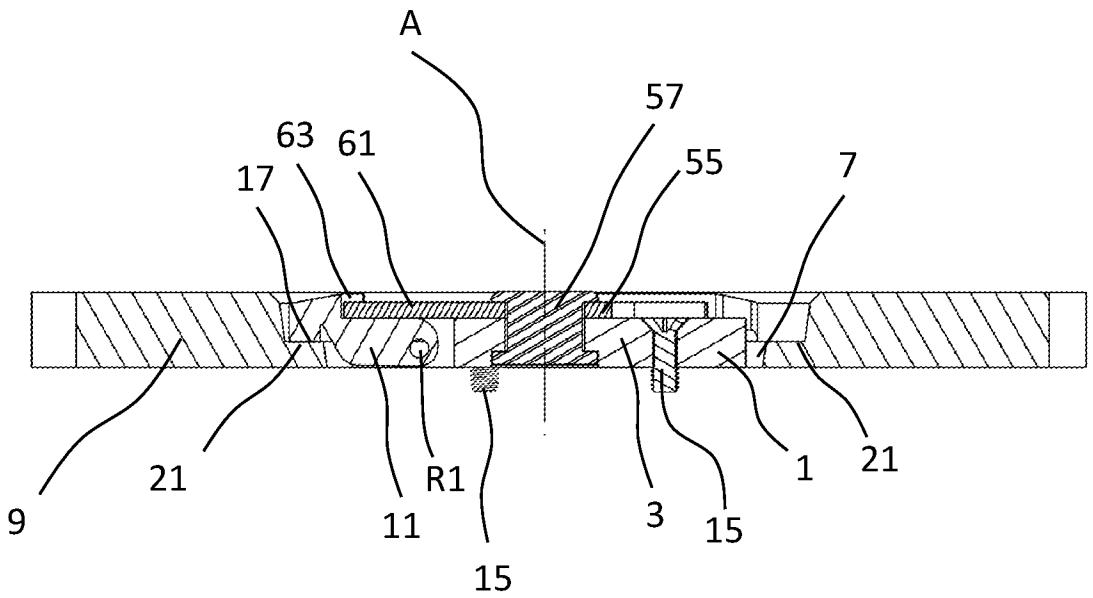
FIG. 18 is a cross-sectional view of the third embodiment of the invention, the three levers being in the locking position.

FIGS. 16 to 18 show a third embodiment of the invention, according to which the locking means comprise a third lever 12 similar to the levers 10, 11 described previously. The three levers 10, 11, 12 pivot, from the unlocking position to the locking position, about three pivoting pins R0, R1, R2 carried by the base 3 of the disc 1, in a plane perpendicular to the axial direction A and perpendicular to three intersecting planes, preferably making an angle of 120° between each other. A housing 16 of the base 3 of the disc 1 is designed to receive each lever 10, 11, 12 in the locking position.

The clamping means comprises a clamping ring 55, which is movable in rotation about the axial direction A of the base 3 of the disc 1. The clamping ring 55 is gripped on the base 3 of the disc 1 using a rivet 57. It comprises three radial arms 61 each having an edge 63 inclined relative to the axial direction A. In the unlocking position, the clamping ring 55 is in a position for which the three arms 61 extend between the housings 16 of the base 3 of the disc 1 so that the three levers 10, 11, 12 can pivot into the locking position.

Once the levers 10, 11, 12 are in this position, the clamping ring 55 is rotated about the axial direction A to clamp the three levers using the three radial arms 61. The inclined edge 63 of each arm 61 allows the clamping force to be transmitted more progressively, as the ring rotates about the axial direction A. Thus, the clamping ring 55 rotates the levers 10, 11, 12 about their pivoting pin R0, R1, R2 so that they transmit the clamping force onto the opening 7 of the base 9 by overlapping of the shoulders 17, 21.

This third embodiment with three levers distributes the clamping force on three sectors on the periphery of the opening of the base, preferably at 1200 from each other.

Figure 19:
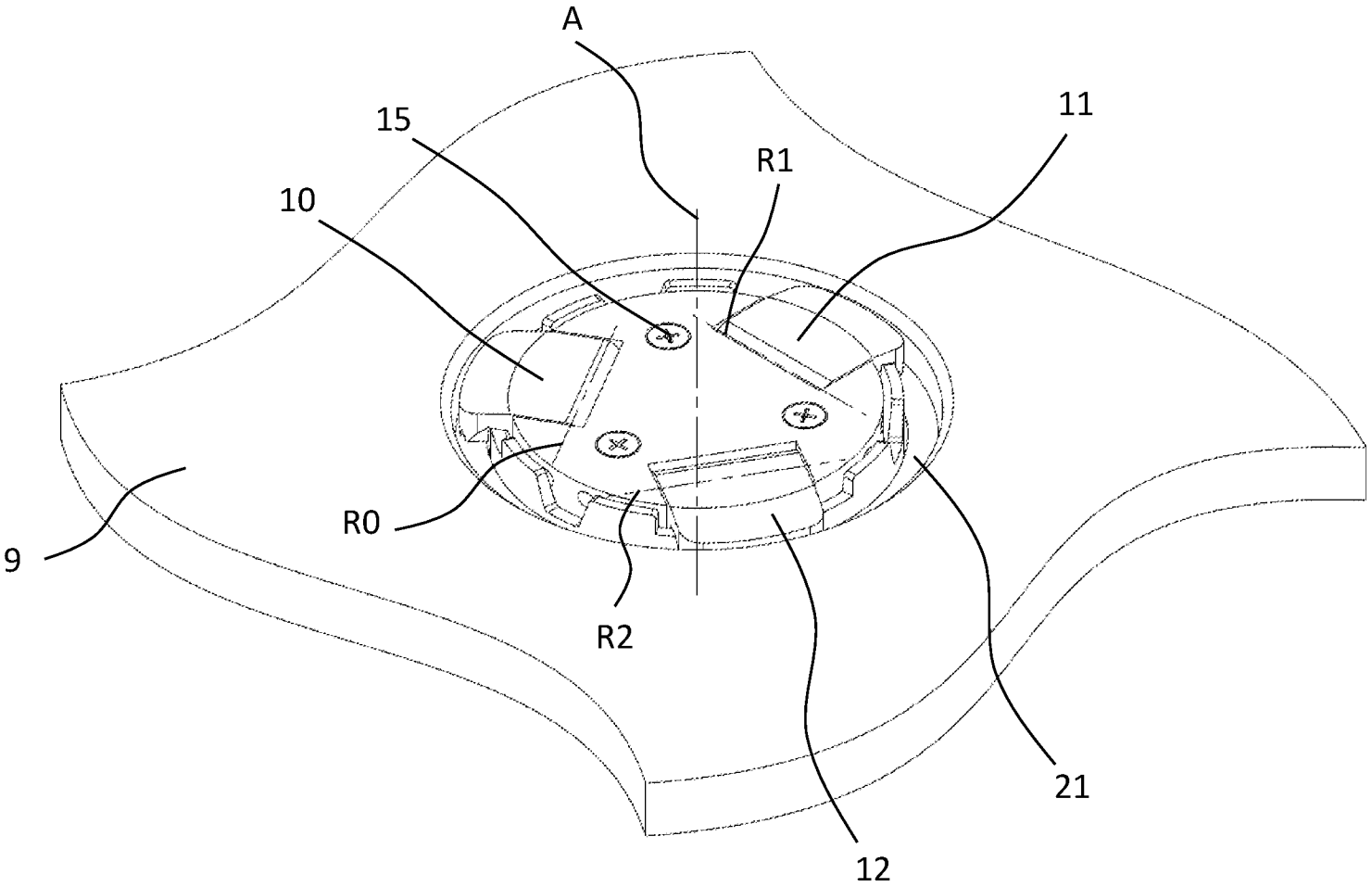
FIG. 19 is a perspective view of a variant of the third embodiment of the invention, the three levers being in the locking position.
Figure 20:
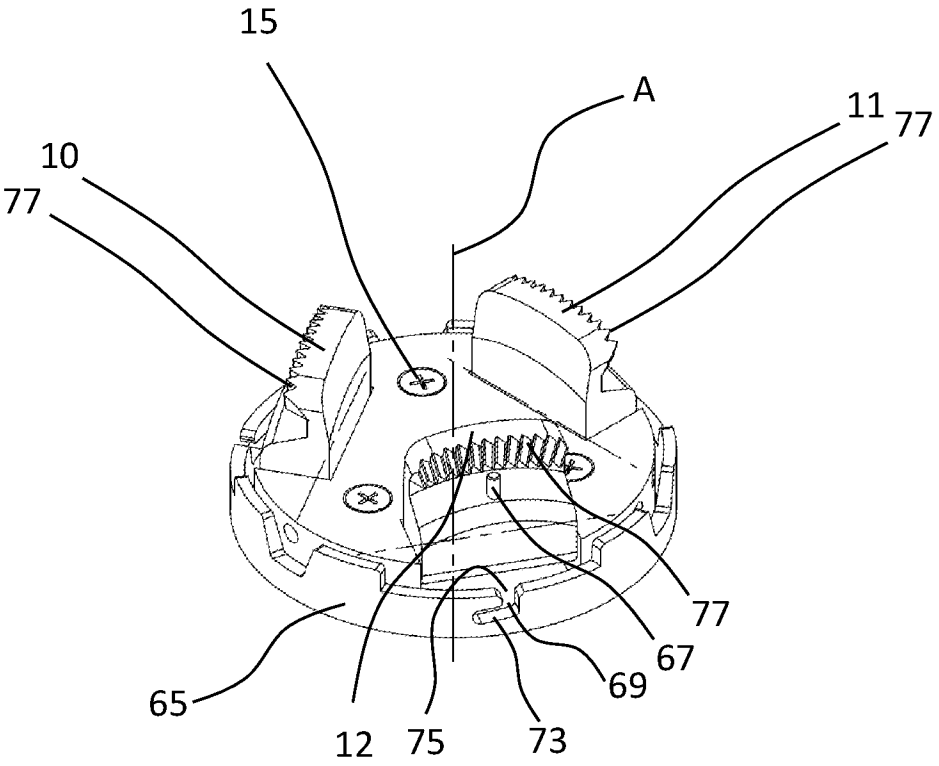
FIG. 20 is a perspective view of the variant of the third embodiment of the invention, the three pivoting levers being in an unlocking position.
Figure 21:
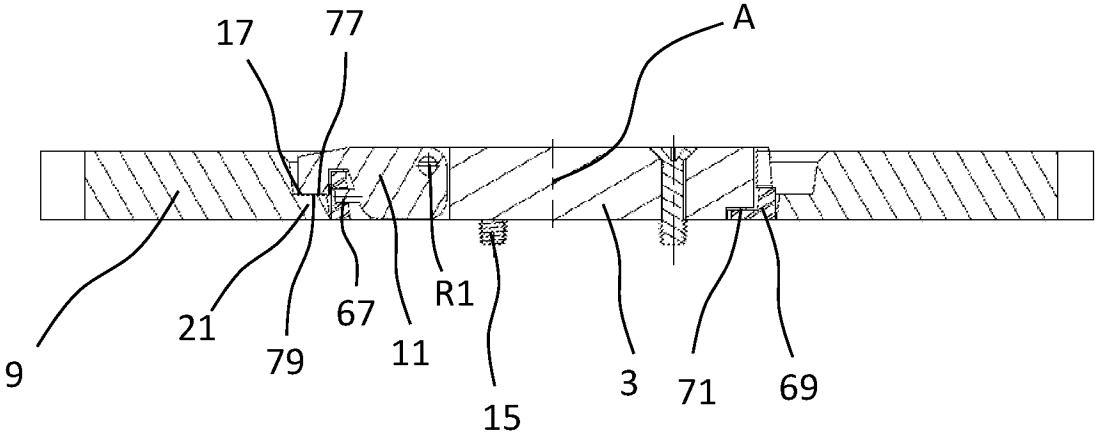
FIG. 21 is a cross-sectional view of the variant of the third embodiment of the invention, the three levers being in the locking position.

FIGS. 19 to 21 show a variant of the third embodiment of the invention, which has a different clamping means. The latter comprises a clamping ring 65, which is movable in rotation about the axial direction A of the base 3 of the disc 1, with which each of the three levers 10, 11, 12, in the locking position, is engaged using a lug 67 inserted in one of the three tangential notches 69 of the clamping ring 65. The clamping ring 65 is housed in a shoulder 71 of the base 3 of the disc 1 and each of the three tangential notches 69 has a slope 73 relative to the axial direction A. In the unlocking position, the clamping ring 65 is in a position for which the three tangential notches 69 have an opening 75, arranged in the intersecting plane perpendicular to the pivoting pin R0, R1, R2 and passing through the lug 67 attached to the three levers 10, 11, 12 so that they can pivot into the locking position.

Once the levers 10, 11, 12 are in this position, the clamping ring 65 is rotated about the axial direction A to clamp the three levers using the lug 67 engaged in the three tangential notches 69. The slope 73 allows the clamping force to be transmitted more progressively, as the clamping ring 65 rotates about the axial direction A. Thus, the clamping ring 65 rotates the levers 10, 11, 12 about their pivoting pin R0, R1, R2 so that they transmit the clamping force onto the opening 7 of the base 9 by overlapping of the shoulders 17, 21.

The various embodiments of the invention described previously relate to locking levers with no set of teeth. The same is true of the periphery of the opening of the base.

However, the invention advantageously provides that these levers and this opening should be equipped with complementary set of teeth. On the figures showing the various embodiments, the teeth 77 extend along a radius of curvature of the lever 10, 11, 12 or of the opening 7 of the base 9. Preferably, the curvature of the lever or of the opening is circular. In the locking position, the lever thus reproduces the set of teeth of an ordinary removable binding disc, for which the teeth 77 protrude in a plane perpendicular to the axial direction A of the base 3 of the disc 1, such that the device is adapted to any standard binding, for which the teeth 79 of the complementary set of teeth, formed on the periphery of the opening 7, also extend perpendicular to the axial direction A of the opening. Note that the teeth 77 of the lever can be inclined relative to the axial direction A, forming a conical ring centered on this direction. The same applies for the teeth 79 of the complementary set of teeth formed in the opening 7 of the base 9.

The invention claimed is:

1. A device for locking a binding to a snowboard, comprising a disc, having a base attached to the snowboard and housed in an opening of a base of the binding and a first lever, which is hinged to the base of the disc and pivots from a first unlocking position to a first locking position, wherein the base of the binding is locked in any angular position relative to an axial direction of the base of the disc, the opening of the base of the binding being provided with a shoulder, wherein the first lever is a first locking lever, overlapping the shoulder of the opening of the base of the binding in the first locking position and transmitting a clamping force onto said shoulder, exerted by a clamping means, the first lever fitting into the opening of the base of the binding in the first unlocking position, and wherein the first lever pivots about a first pin, that is fixed to the base of the disc in a first angular position with respect to the axial direction.

2. The locking device according to claim 1, further comprising a second locking lever, hinged to the base of the disc and pivoting from a second unlocking position to a second locking position, wherein the second lever is a second locking lever, overlapping the shoulder of the opening of the base of the binding in the second locking position and transmitting a clamping force onto said shoulder, exerted by the clamping means, the second lever fitting into the opening of the base of the binding in the second unlocking position, wherein the second lever pivots about a second pin, that is fixed to the base of the disc in a second angular position with respect to the axial direction, and wherein the two pivoting pins are parallel to each other.

3. The locking device according to claim 2, wherein the clamping means comprises two bolts, controlled in translation relative to the base by a cam, which is movable in rotation about the axial direction, for exerting, in the locking position, the clamping force using a heel of each of the two locking levers, engaged with the two bolts.

4. The locking device according to claim 3, wherein the heel of the locking lever has a slope relative to the axial direction.

5. The locking device according to claim 2, wherein the clamping means comprises a clamping ring, which is movable in rotation about the axial direction, for exerting, in the locking position, the clamping force using a bearing surface engaged with a complementary bearing surface of both locking levers, the two bearing surfaces forming a helical screw thread.

6. The locking device according to claim 1, further comprising a second locking lever and a third locking lever, hinged to the base of the disc and pivoting from a second, respectively a third unlocking position to a second, respectively a third locking position, wherein the second, respectively the third lever is a second, respectively a third locking lever, overlapping the shoulder of the opening of the base of the binding in the second, respectively the third locking position and transmitting a clamping force onto said shoulder, exerted by the clamping means, the second, respectively the third lever fitting into the opening of the base of the binding in the second, respectively the third unlocking position, wherein the second, respectively the third lever pivots about a second, respectively a third pin, that is fixed to the base of the disc in a second, respectively a third angular position with respect to the axial direction, and wherein the three pivoting pins are perpendicular to three intersecting planes, making an angle of 120° between each other.

7. The locking device according to claim 1, wherein the clamping means comprises a clamping lever, which is hinged to the base of the disc, about a pivoting pin, inserted in grooves formed in the base, to slide relative to the base and to exert, in the locking position, the clamping force using the pivoting pin engaged with a heel of the locking lever.

8. The locking device according to claim 1, wherein the clamping means comprises a clamping ring provided with radial arms and wherein the ring is movable in rotation about the axial direction, for exerting, in the locking position, the clamping force using the rotation of the radial arms.

9. The locking device according to claim 1, wherein the clamping means comprises a clamping ring provided with tangential notches and wherein the ring is movable in rotation about the axial direction, for exerting, in the locking position, the clamping force using the rotation the tangential notches, engaged with a lug of the locking lever.

* * * * *